US006304159B1

(12) United States Patent
Ono et al.

(10) Patent No.: US 6,304,159 B1
(45) Date of Patent: Oct. 16, 2001

(54) DIELECTRIC FILTER WITH ADJUSTABLE FREQUENCY BANDWIDTH

(75) Inventors: Shoji Ono; Katsuhisa Murakami; Masahiro Funahashi, all of Ise (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/458,669

(22) Filed: Dec. 10, 1999

(30) Foreign Application Priority Data

Dec. 10, 1998 (JP) ..... 10-350931

(51) Int. Cl.[7] ..... H01P 1/20
(52) U.S. Cl. ..... 333/206; 333/202; 333/207
(58) Field of Search ..... 333/202, 206, 333/207

(56) References Cited

U.S. PATENT DOCUMENTS

| | | | | |
|---|---|---|---|---|
| 4,768,003 | * | 8/1988 | Kawakami et al. | 333/202 |
| 5,230,093 | * | 7/1993 | Rich et al. | 333/202 |
| 5,939,959 | * | 8/1999 | Ono | 333/206 |
| 6,163,237 | * | 12/2000 | Toda et al. | 333/206 |
| 6,169,464 | * | 1/2001 | Moon et al. | 333/206 |

FOREIGN PATENT DOCUMENTS

| | | |
|---|---|---|
| 0 345 507 | 12/1989 | (EP) . |
| 0 347 774 | 12/1989 | (EP) . |
| 0 442 418 A2 | 8/1991 | (EP) . |
| 0 757 401 A2 | 2/1997 | (EP) . |
| 0 837 519 A1 | 4/1998 | (EP) . |
| 0 838 875 A1 | 4/1998 | (EP) . |
| 4-8643 | 12/1985 | (JP) . |
| 63-312701 | 12/1988 | (JP) . |
| WO 92/15123 | 9/1992 | (WO) . |

* cited by examiner

*Primary Examiner*—Robert Pascal
*Assistant Examiner*—Patricia T. Nguyen
(74) *Attorney, Agent, or Firm*—Larson & Taylor, PLC

(57) ABSTRACT

A dielectric filter comprising a plurality of juxtaposed resonators provided within a dielectric ceramic block, an outer conductor layer provided on outer surface portions of the block with exception of an open-circuit end surface, and input/output pads provided on one lateral side surface of the block at respective positions close to the open-circuit end surface and opposite to the associated resonators, wherein a strip conductor member is provided transversely between the adjacent through holes on the first end surface of the block so that one end of the strip conductor member is connected to the outer conductor layer on one of a first and second lateral side surfaces of the block, and other end is separated from the other lateral side surface to form an open circuit end, whereby defining a non-conductive region between the open circuit end of the strip conductor member and the outer conductor layer on the other lateral side surface.

16 Claims, 11 Drawing Sheets

DIELECTRIC FILTER WITH ADJUSTABLE FREQUENCY BANDWIDTH

BACKGROUND OF THE INVENTION

1. Field of the Invention

The present invention relates to a piezoelectric filter including a plurality of juxtaposed dielectric ceramic resonators, and a method of adjusting its frequency bandwidth.

2. Related Background Art

There have been proposed various dielectric filters comprising a dielectric ceramic block including a plurality of juxtaposed resonators. In the dielectric ceramic block a plurality of through holes are provided in juxtaposed configuration. Each of the through holes is formed with an inner conductor on its inner wall. The dielectric ceramic block has an outer conductor provided on the outer surface portions thereof except an open circuit end surface portion at which one end of each through hole meets.

One example of such conventional dielectric filters is shown in FIG. 1 of the accompanying drawings. The illustrated filter A comprises a dielectric ceramic block B including two resonators C1 and C2 therein. An outer conductor D is provided on the outer surface portions of the block B except an open circuit end surface portion E and input/output terminal pads F are provided on one lateral surface portion of the block B provided with the outer conductor D and are electrically separated from the outer conductor by peripheral gaps. On the open circuit end surface portion E a transverse strip conductor G is provided for separating the resonators C1 and C2 from each other. The strip conductor G has both ends connected to the outer conductor D. This strip conductor G is operative to provide polarization on a high band side. The electromagnetic coupling between the resonators C1 and C2 can be regulated by modifying the configuration and/or width of the strip conductor G.

Recently, with the spread of digital communication system such as mobile phone it is required to use a dielectric filter having a wider frequency band. However, with the conventional filter mentioned above, the provision of the transverse strip conductor on the open-circuit end surface of the block is operative to provide polarization on a high band side, but the frequency bandwidth is reduced. Meanwhile, the use of dielectric filter having a narrow frequency band is required for some applications. However, the dielectric filter having the arrangement mentioned above can not be adjusted to have a desired frequency band in accordance with the requirement for an application.

SUMMARY OF THE INVENTION

In view of these circumstances, it is therefore an object of the present invention to provide a dielectric filter in which a bandwidth may be modified, and method of adjusting the bandwidth thereof.

According to one aspect of the invention, there is provided a dielectric filter comprising;

a dielectric ceramic block having a first and second end surfaces, a first and second lateral side surfaces opposite to each other, and a third and fourth lateral side surfaces to each other;

a plurality of juxtaposed resonators each resonator including a through hole provided within the block to be extended from the first end surface to the second end surface of the block and an inner conductor layer provided on an inner wall surface of the through hole;

an outer conductor layer provided on outer surface portions of the block with exception of said first end surface;

input/output pads provided on the first lateral side surface of the block at respective positions close to the first end surface and opposite to the associated resonators, each pad being capacitively coupled with the associated resonator;

a strip conductor member provided transversely between the adjacent through holes on said first end surface of the block, the strip conductor member having one end connected to the outer conductor layer on one of the first and second lateral side surfaces of the block, and other end formed as an open circuit end; and a non-conductive region defined between the open circuit end of the strip conductor member and the outer conductor layer on the other of the first and second lateral side surface.

In one embodiment of the invention, one end of the strip conductor member may be connected to the outer conductor layer on the first lateral side surface of the block where the input/output pads are positioned. In this case the non-conductive region may be defined between the open circuit end of the strip conductor member and the outer conductor layer on the second lateral side surface opposite to the first lateral side surface.

Alternately, one end of the strip conductor member may be formed as an open circuit, and the other end may be connected to the outer conductor layer on the second lateral side surface of the block where no input/output pad is positioned. In this case, the non-conductive region is defined between the open circuit end of the strip conductor member and the outer conductor layer on the first lateral side surface of the block.

According to another aspect of the invention, there is provided a method of adjusting the frequency bandwidth of a dielectric filter comprising a dielectric ceramic block having a first and second end surfaces, and a first and second lateral side surfaces opposite to each other, a plurality of juxtaposed resonators each resonator including a through hole provided within the block to be extended from the first end surface to the second end surface of the block and an inner conductor layer provided on an inner wall surface of the through hole, an outer conductor layer provided on outer surface portions of the block with exception of said first end surface, and input/output pads provided on the first lateral side surface of the block at respective positions close to said first end surface and opposite to the associated resonators, each pad being capacitively coupled with the associated resonator, wherein the method comprises the steps of:

forming a strip conductor member transversely between the adjacent through holes on said first end surface of the block so that one end of the strip conductor member is connected to the outer conductor layer on one of the first and second lateral side surfaces of the block, and other end is separated from the other lateral side surface to form an open circuit end, whereby defining a non-conductive region between the open circuit end of the strip conductor member and the outer conductor layer on the other lateral side surface; and setting a width or space of the non-conductive region or insulation gap whereby adjusting the frequency bandwidth.

In the testing of a frequency characteristic it has been found that the dielectric filter thus arranged has a frequency characteristic in which 3 dB frequency bandwidth is wider than that of the conventional arrangement such as one illustrated in FIG. 1. The wording "3 dB frequency bandwidth" means a frequency bandwidth at a range below 3 dB from the minimum value of an insertion loss in the band.

FIG. 2A illustrates one measured example of a frequency characteristic (a) and a reflected wave characteristic (b) of the conventional dielectric filter having a strip conductor member arranged as shown in FIG. 1. The used dielectric filter includes input/output pads provided on the lateral side surface of a dielectric ceramic block at respective positions close to an open circuit end surface of the block and opposite to the associated resonators so that each pad is capacitively coupled with the associated resonator.

After measuring of the frequency characteristic in this dielectric filter, the dielectric filter was modified as follows. The transverse strip conductor member was removed at one end thereof connected to the outer conductor layer on the lateral side surface of the block where no input/output pad is positioned as in the present invention. A non-conductive region was defined between the one open end of the strip conductor member and the outer conductor layer. This modified dielectric filter has a frequency characteristic (a) and a reflected wave characteristic (b) as shown in FIG. 2B. It will be seen in FIG. 2B that the frequency characteristic (a) has a flattened central frequency zone and thus a wider 3 dB frequency bandwidth is formed as compared with that of FIG. 2A.

FIG. 3A illustrates another measured example of a frequency characteristic (a) and a reflected wave characteristic (b) of the conventional dielectric filter having a strip conductor member arranged as shown in FIG. 1. In this case, the used dielectric filter also includes input/output pads provided on the lateral side surface of a dielectric ceramic block at respective positions close to an open circuit end surface of the block and opposite to the associated resonators.

After measuring of the frequency characteristic in this dielectric filter, the dielectric filter was modified as follows. The transverse strip conductor member was removed at the other end thereof connected to the outer conductor layer on the opposite lateral side surface of the block where input/output pads are positioned as in the present invention. A non-conductive region was defined between this open end of the strip conductor member and the outer conductor layer. The frequency characteristic (a) of this modified dielectric filter is shown in FIG. 3B and has a flattened central frequency zone and thus a wider 3 dB frequency bandwidth is formed as compared with that shown in FIG. 3A.

Thus, it can be realised that the bandwidth of the frequency characteristic is enlarged by the provision of non-conductive region on one of the end portions of the transverse strip conductor member.

The frequency characteristic of the filter can be regulated to have a desired frequency bandwidth by adjusting the width or space of the non-conductive region.

DETAILED DESCRIPTION OF THE PREFERRED EMBODIMENTS

Figure 1:
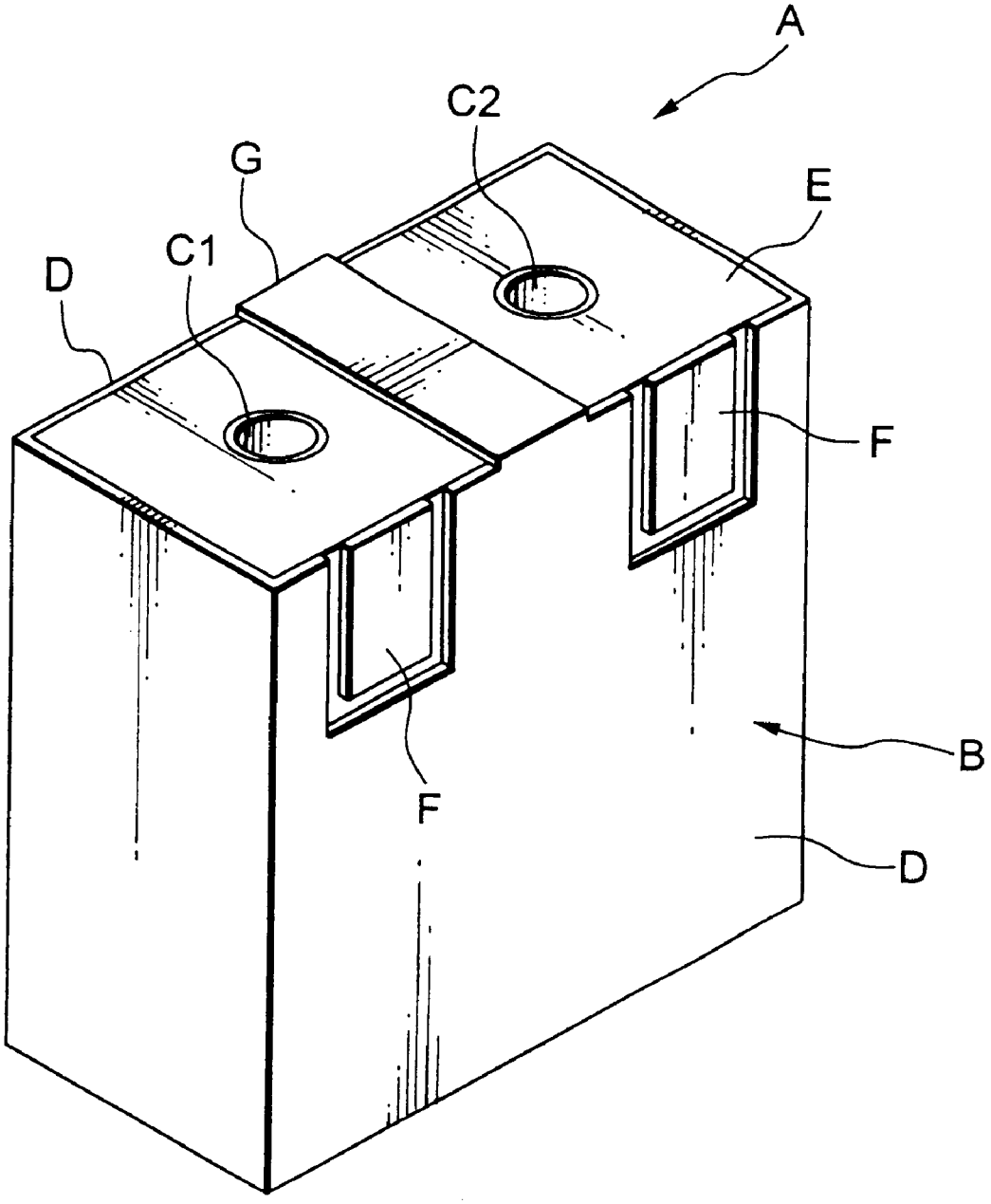
FIG. 1 PRIOR ART
FIG. 1 is a schematic perspective view showing an example of a conventional dielectric filter.

Now, the present invention will be described in greater detail with reference to the accompanying drawings that illustrate two preferred embodiments of the invention. It will be noted that those components that mutually same or similar are denoted by the same reference numerals or symbols and will not be described repeatedly.

Figure 4:
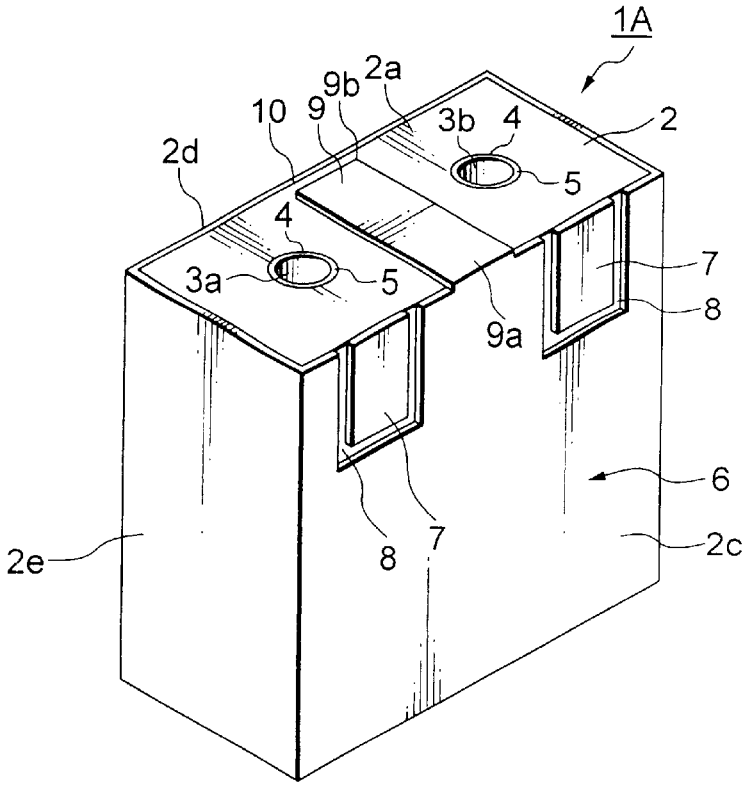
FIG. 4 is a schematic perspective view showing a dielectric filter according to one embodiment of the invention.
Figure 5:
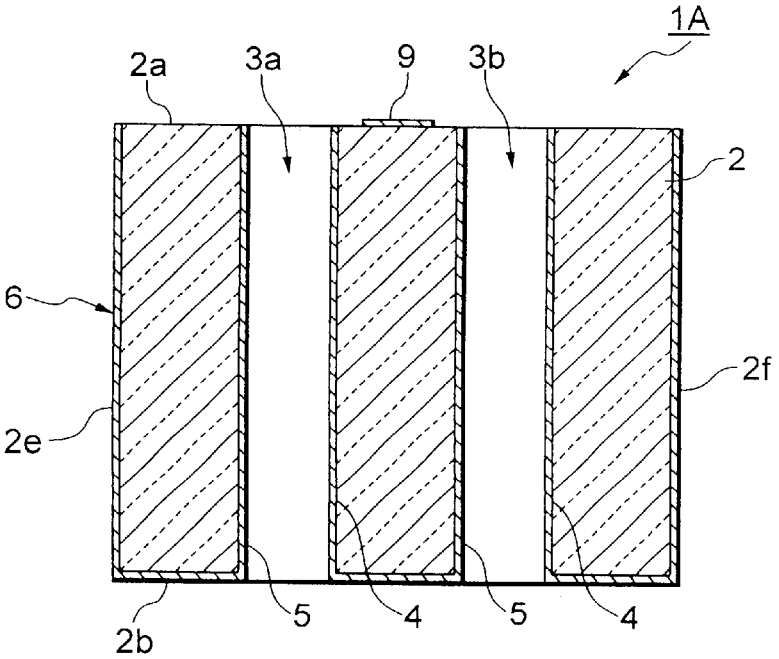
FIG. 5 is a longitudinal section of the filter of FIG. 4.
Figure 6:
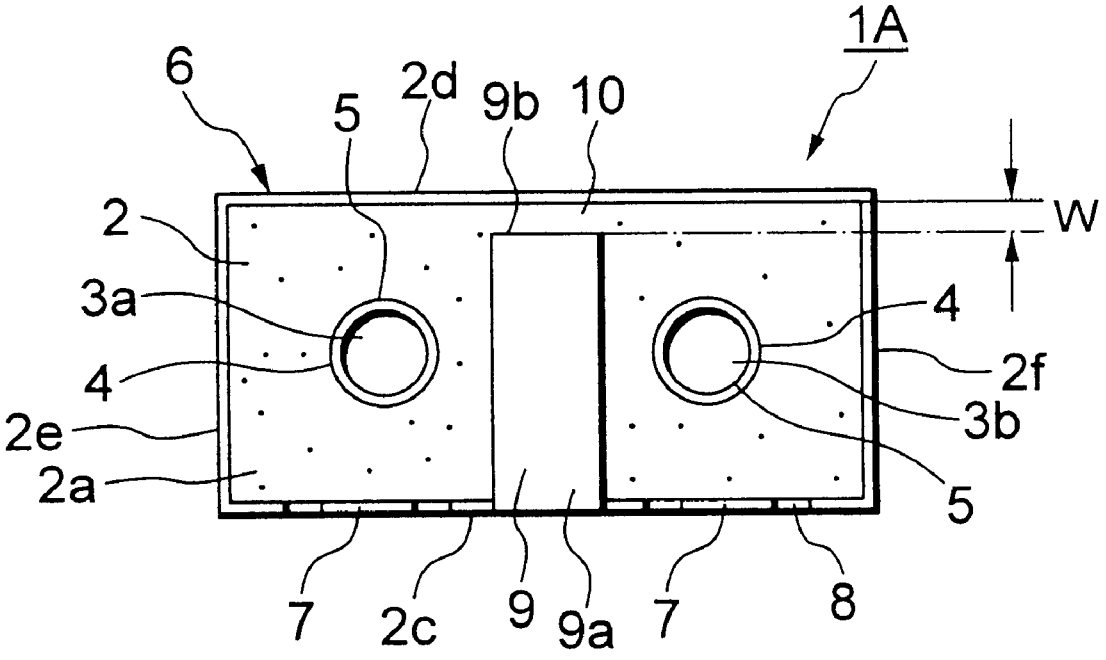
FIG. 6 is a schematic plan view showing the filter of FIG. 4.

FIGS. 4, 5 and 6 schematically illustrate a first embodiment of the invention, which is a two-stage type dielectric filter 1A comprising a single dielectric ceramic block 2 and a pair of resonators 3*a* and 3*b*. The dielectric ceramic block 2 has a substantially rectangularly parallelepipedic profile having a first and second end surfaces, and a first, second, third and fourth lateral side surfaces. The block 2 is typically made of dielectric ceramic material such as BaO—$TiO_2$ or BaO—$TiO_2$-rare earth oxide. The resonators 3*a* and 3*b* are arranged in parallel with each other along the longitudinal direction of the dielectric ceramic block 2. Each of the resonators 3*a* and 3*b* comprises a through hole 4 extending from the first end surface to the second end surface, and an inner conductor layer 5 provided on an inner wall surface of the through hole 4.

The second end surface 2*b* and all the side surfaces 2*c*–2*f* of the block 2 are provided with an outer conductor layer 6 which is operative to form a shield electrode. Each of the resonators 3*a* and 3*b* has a length substantially corresponding to a resonant length of ¼λ of a resonance frequency.

Input/output pads 7 are provided on the first lateral side surface 2*c* of the block 2 at respective positions close to said first end surface 2*a* and opposite to the associated resonators. Each pad 7 is capacitively coupled with the associated resonator. The Input/output pads 7 are separated from the outer conductor layer 6 by a non-conductive zone 8 and are electrically connected to terminals of a desired circuit arrangement provided on a printed circuit board not shown.

Now, some principal portions of the illustrated embodiment will be described in detail.

As will be seen in FIGS. 4 and 6, a strip conductor member 9 is provided transversely between the through holes 4 on the first end surface 2*a* of the block 2. The transverse strip conductor member 9 has one end 9*a* connected to the outer conductor layer 6 on the first lateral side surface 2*c* of the block 2 where the input/output pads 7 are positioned. The other end 9*b* of the strip conductor member 9 is formed as an open circuit end or a free end. The transverse strip conductor member 9 may be formed by means of patterning at a high precision using a screen printing method. A non-conductive region or insulation gap 10 is defined between the open circuit end 9*a* of the strip conductor member 9 and the outer conductor layer 6 on the second lateral side surface 2*d* opposite to the first lateral side surface 2*c*.

In accordance with the embodiment shown in FIGS. 4 to 6 a testing sample of the dielectric filter was prepared as follows.

In order to provide such a testing dielectric filter having central frequency of 1960 MHz, the dielectric ceramic block 2 has dielectric constant of 78, and an external size which is a length a resonance length) of 4.3 mm, a width of 3.8 mm and a height of 1.9 mm. A pair of resonators 3*a* and 3*b* are formed so that each resonator has an inner diameter of 0.56 mm and a distance between the centers thereof is 1.7 mm. The transverse strip conductor member 9 has a width of 0.6 mm.

FIGS. 7A–7D illustrate how the filter characteristic of the testing dielectric filter may be varied by variously changing the width or spacing w of the non-conductive zone 10.

Figure 7A:
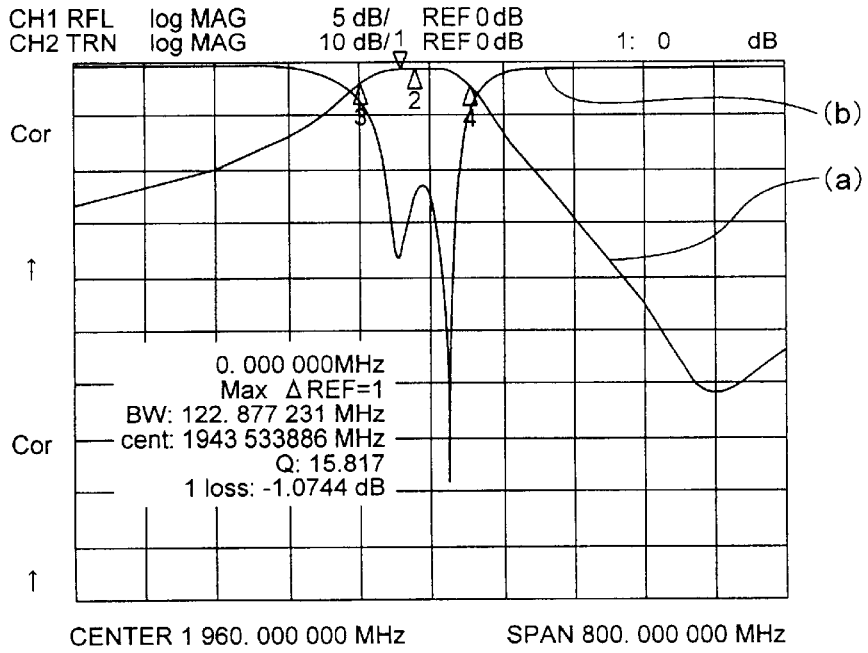
FIGS. 7A, 7B, 7C and 7D are graphs showing the filter characteristics of the filter of FIG. 4.
Figure 7B:
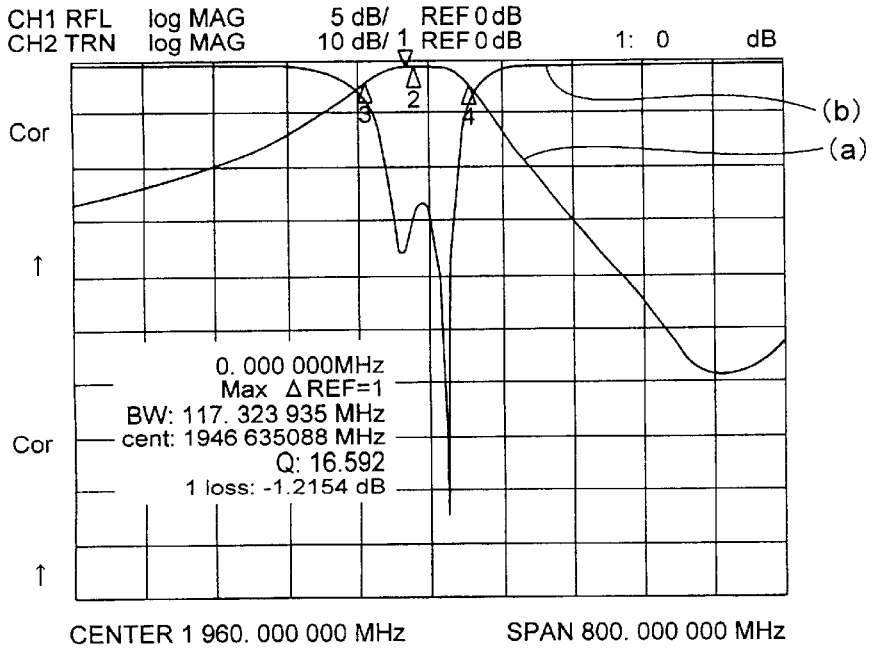
Figure 7C:
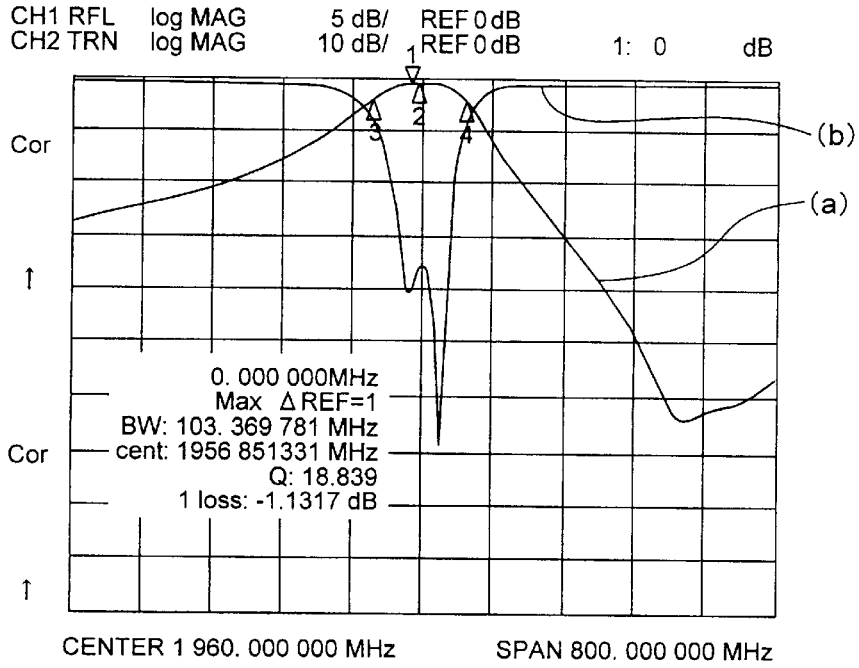
Figure 7D:
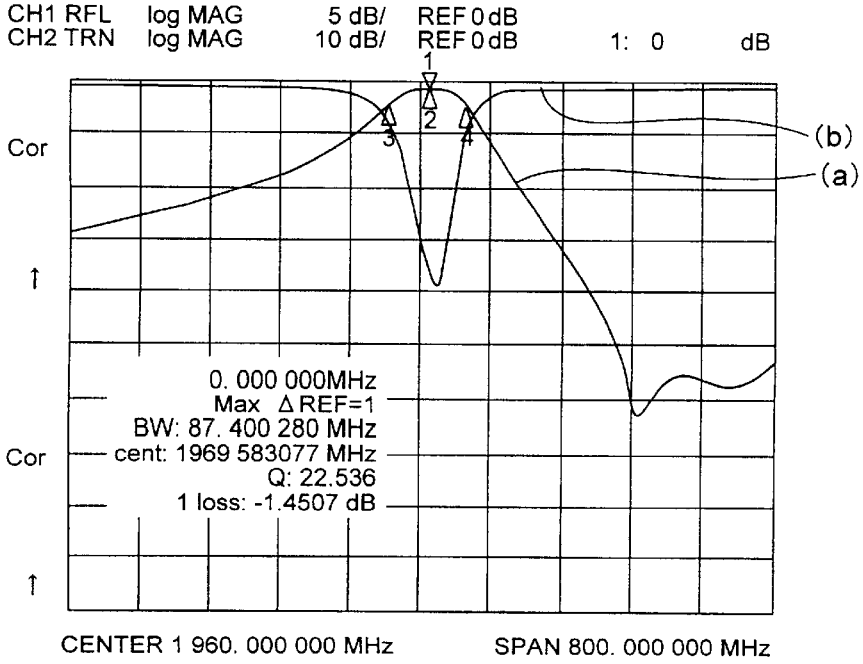

FIG. 7A shows the measured result of the filter characteristic of the filter with w=0.20 mm. FIG. 7B shows the measured result of the filter characteristic of the filter with w=0.40 mm. FIG. 7C shows the measured result of the filter characteristic of the filter with w=0.70 mm. FIG. 7D shows the measured result of the filter characteristic of the filter with w=0.96 mm. In the graphs shown in the drawings including FIGS. 7A–7D, the axis of ordinate represents an attenuation with the scale in 10 dB while the abscissa represents a frequency with the scale in 800 MHz and the center frequency is 1960 MHz. Also, a graph (a) represents a frequency characteristic and a graph (b) a reflected wave characteristic measured simultaneously.

Figure 2A:
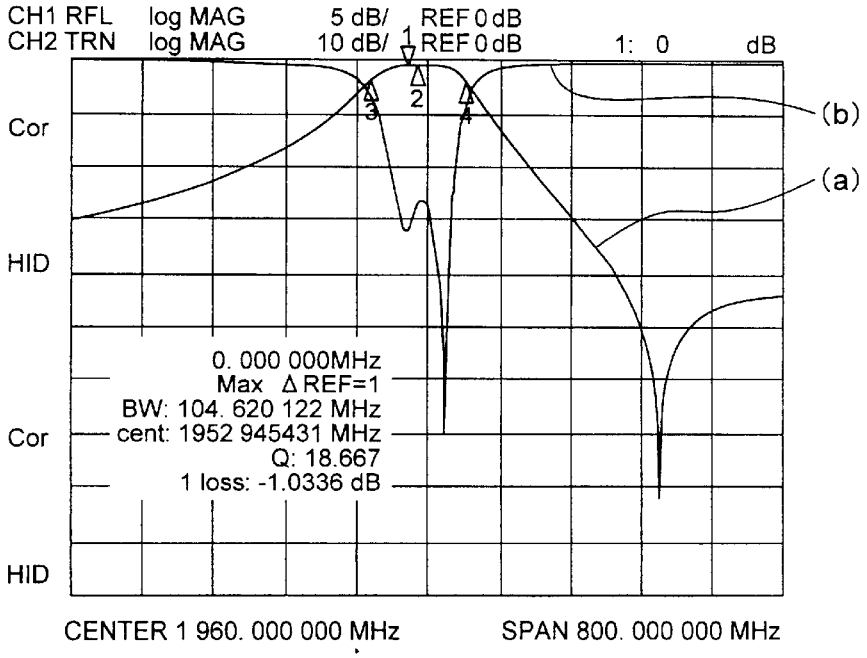
FIG. 2A is graphs showing one measured example of the filter characteristic of the filter of FIG. 1.
Figure 2B:
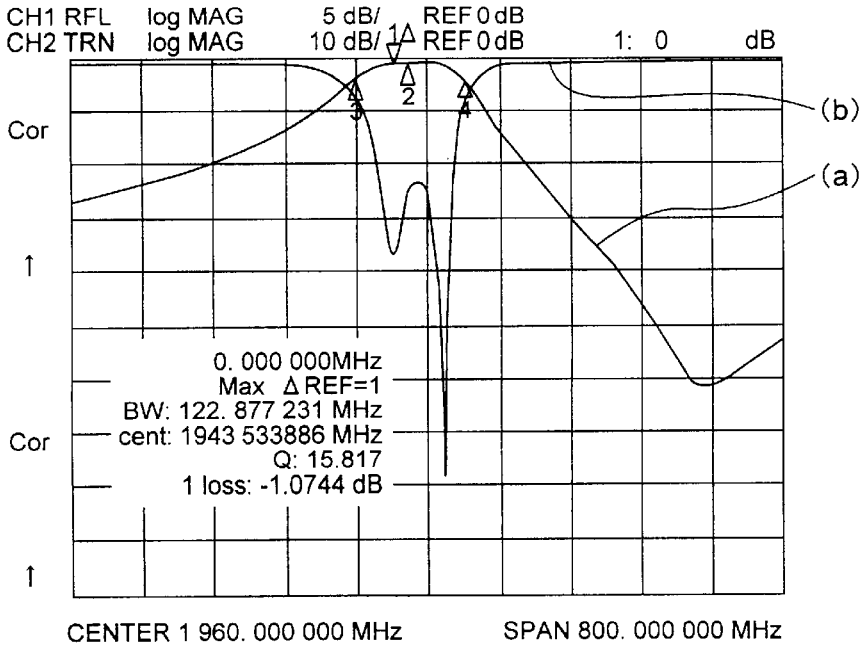
FIG. 2B is graphs showing the filter characteristic when the filter of FIG. 1 is modified to have a non-conductive region on one end of a transverse strip conductor member.

In comparison with the frequency characteristic (a) of the conventional dielectric filter shown in FIG. 2A, it will be appreciated that the 3 dB frequency bandwidth is the most wide in case the width w of the non-conductive zone is 0.20 mm as shown in FIG. 7A. That is, the frequency characteristic (a) of the conventional dielectric filter shown in FIG. 2A has a 3 dB frequency bandwidth Bw3 of 104.62 MHz. With w=0.20 mm shown in FIG. 7A the frequency characteristic (a) has a 3 dB frequency bandwidth Bw3 of 122.88 MHz. With w=0.40 mm shown in FIG. 7B, 3 dB frequency bandwidth Bw3 is 117.32 MHz. With w=0.70 mm shown in FIG. 7C, 3 dB frequency bandwidth Bw3 is 103.87 MHz. With w=0.96 mm shown in FIG. 7D, 3 dB frequency bandwidth Bw3 is 87.40 MHz.

Figure 8:
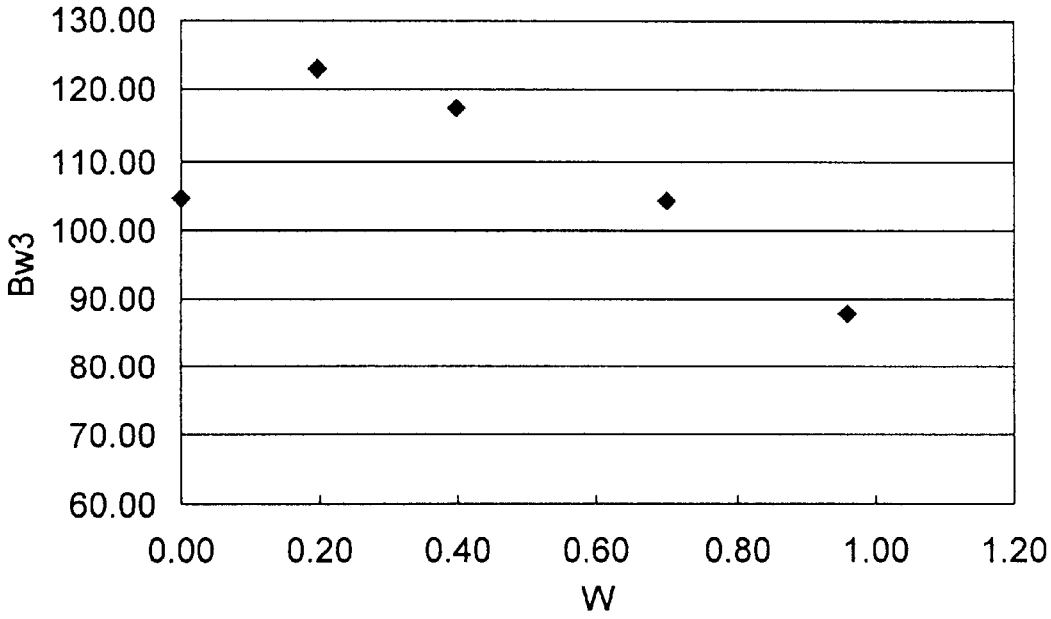
FIG. 8 is a graph showing a relation between the width or space of the transverse strip conductor member and the frequency bandwidth in the filter of FIG. 4.

FIG. 8 illustrates the relation between the 3 dB frequency bandwidth Bw3 and the width w of the non-conductive zone. It will be appreciated that the waveform in vicinity of the center frequency is flattened and thus the frequency bandwidth is broadened as the width w of the non-conductive zone is reduced. The frequency bandwidth is gradually decreased as the width w of the non-conductive zone is increased over 0.20 mm. When the width w of the non-conductive zone is about 0.70 mm the frequency bandwidth becomes smaller than that in case no non-conductive zone is provided (w=0.00 mm) and thus a narrower frequency bandwidth is obtained. Therefore, by regulating the width w of the non-conductive zone based upon this phenomenon, it is possible to adjust the frequency bandwidth in the dielectric filter to a desired range. This means that the dielectric filter may be modified to have either a broader band or a narrower band.

Figure 9:
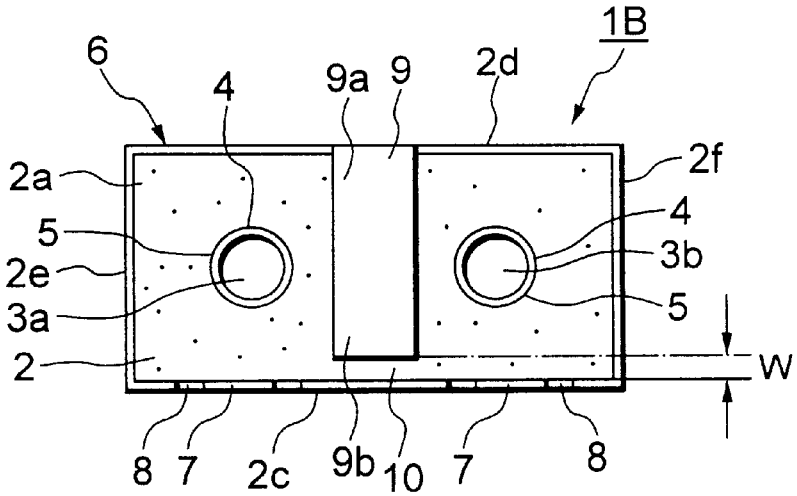
FIG. 9 is a schematic plan view showing a dielectric filter according to another embodiment of the invention.

FIG. 9 illustrates a dielectric filter 1B according to a second embodiment of the invention. In this arrangement, a strip conductor member 9 is provided transversely between the through holes 4 on the first end surface 2*a* of the block 2 as in the case of FIGS. 4 to 6. However, one end 9*a* of the transverse strip conductor member 9 is connected to the outer conductor layer 6 on the second lateral side surface 2*d* of the block 2 opposite to the first lateral side surface 2*c*. The other end 9*b* of the strip conductor member 9 is formed as an open circuit end or a free end. A non-conductive region 10 is defined between the open circuit end 9*a* of the strip conductor member 9 and the outer conductor layer 6 on the first lateral side surface 2*c* where the input/output pads 7 are provided. The other components are arranged in the same manner as that of the first embodiment.

In order to provide a dielectric filter 1B having a central frequency of 1960 MHz, the respective components are arranged to have the same dimensions as that of the filter in the first embodiment.

Figure 10A:
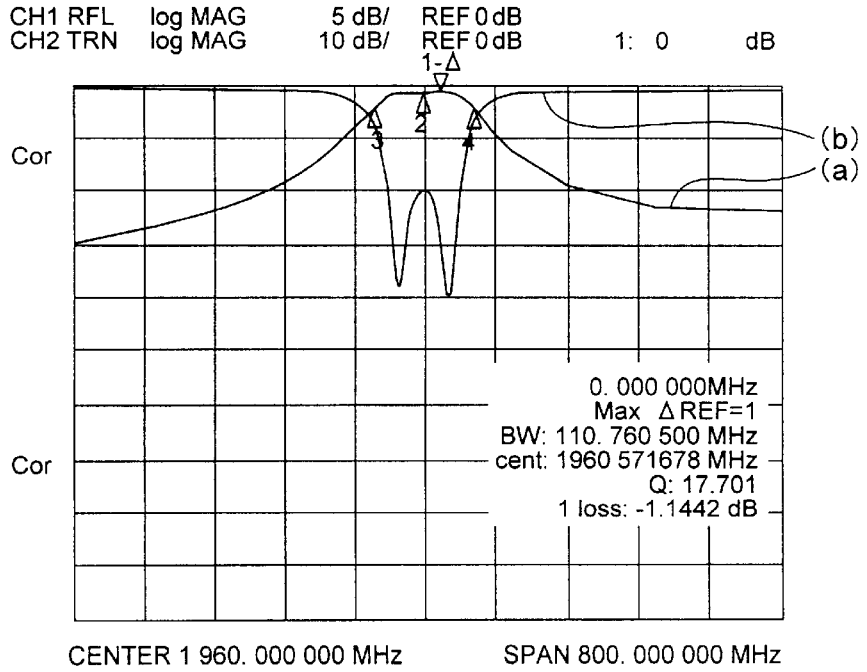
FIGS. 10A, 10B, 10C and 10D are graphs showing the filter characteristics of the filter of FIG. 9.
Figure 10B:
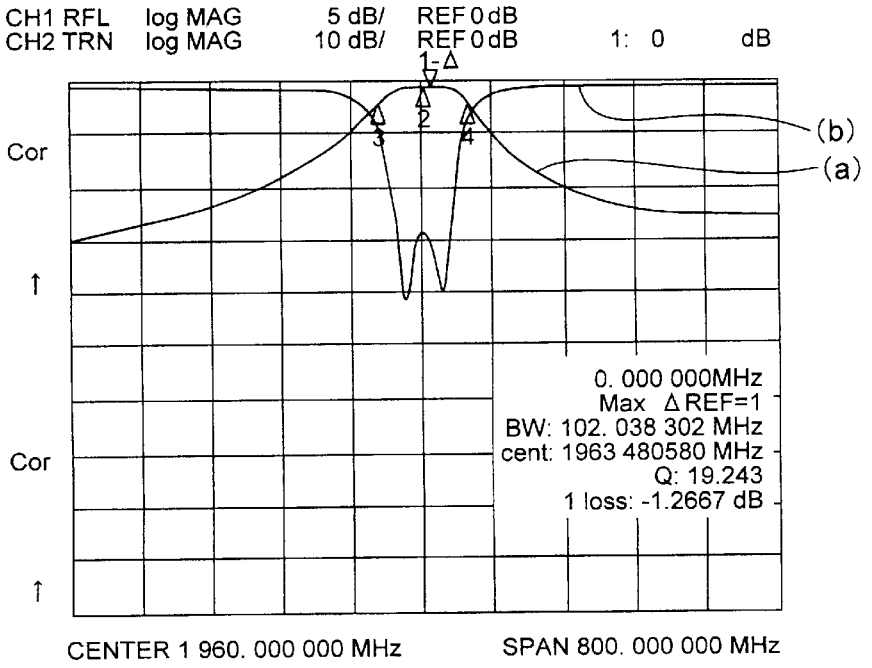
Figure 10C:
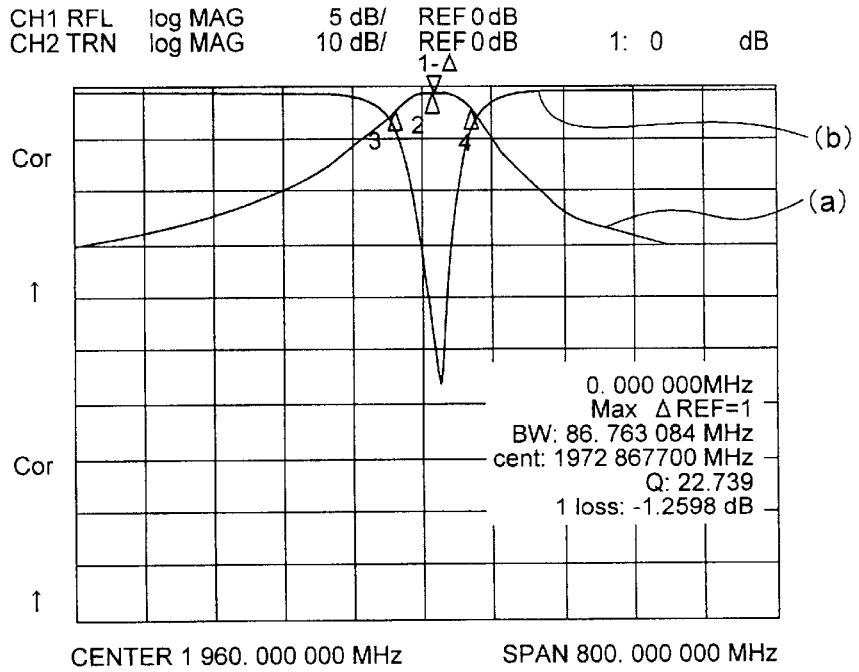
Figure 10D:
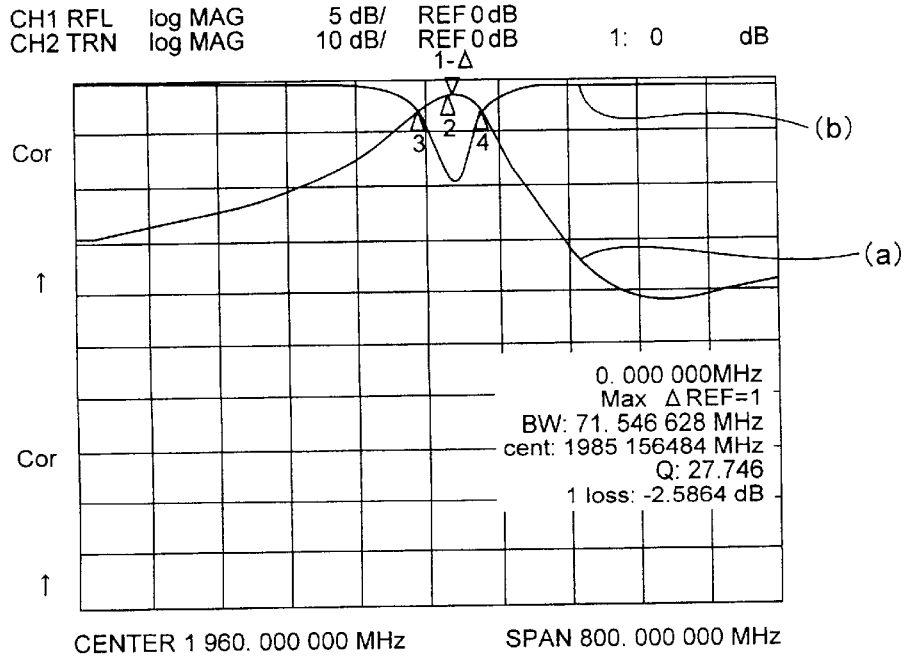

FIGS. 10A–10D illustrate how the filter characteristic of the thus prepared dielectric filter 1B may be varied by variously changing the width or spacing w of the non-conductive zone 10. FIG. 10A shows the measured result of the filter characteristic of the filter with w=0.20 mm. FIG. 10B shows the measured result of the filter characteristic of the filter with w=0.41 mm. FIG. 10C shows the measured result of the filter characteristic of the filter with w=0.68 mm. FIG. 10D shows the measured result of the filter characteristic of the filter with w=0.93 mm.

Figure 3A:
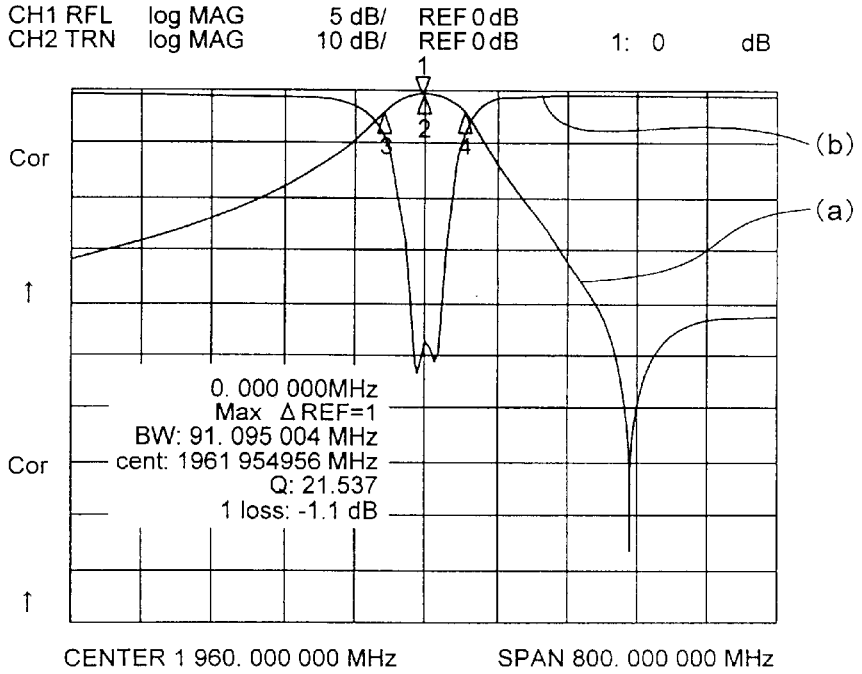
FIG. 3A is graphs showing another measured example of the filter characteristic of the filter of FIG. 1.
Figure 3B:
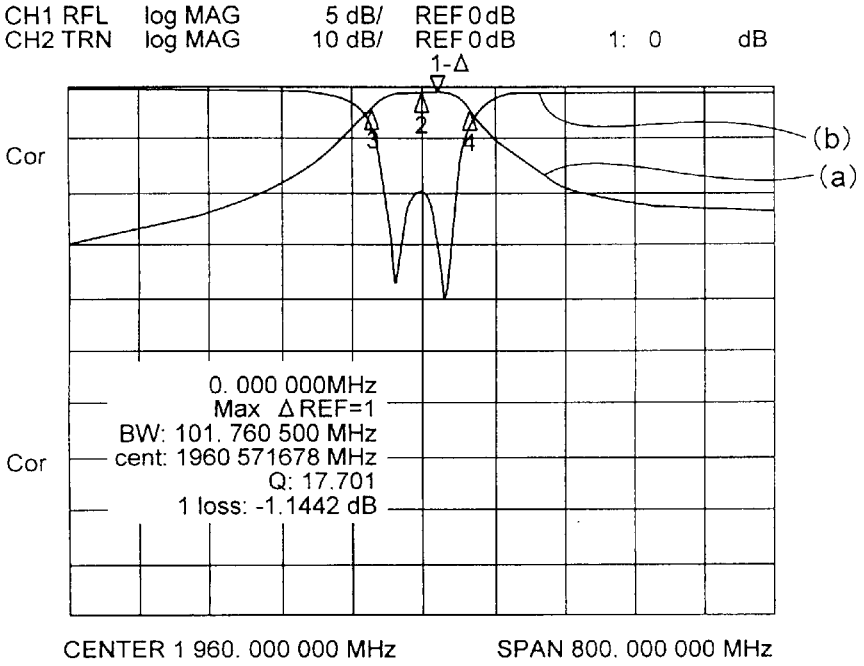
FIG. 3B is graphs showing the filter characteristic when the filter of FIG. 1 is modified to have a non-conductive region on the other end of a transverse strip conductor member.

As will be seen in FIGS. 10A–10D, with w=0.20 mm shown in FIG. 10A the frequency characteristic (a) has a 3 dB frequency bandwidth Bw3 of 110.76 MHz, with w=0.41 mm shown in FIG. 10B 3 dB frequency bandwidth Bw3 is 102.04 MHz, with w=0.68 mm shown in FIG. 10C 3 dB frequency bandwidth Bw3 is 86.76 MHz, and with w=0.93 mm shown in FIG. 10D 3 dB frequency bandwidth Bw3 is 71.55 MHz.

Figure 11:
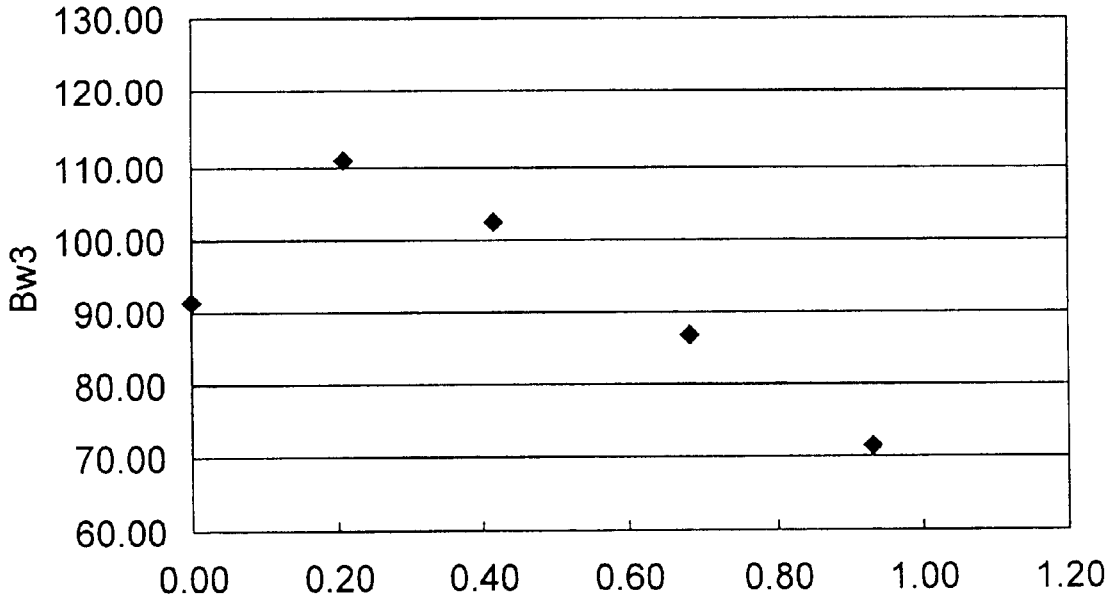
FIG. 11 is a graph showing a relation between the width or space of the transverse strip conductor member and the frequency bandwidth of the filter of FIG. 9.

FIG. 11 illustrates the relation between the 3 dB frequency bandwidth Bw3 and the width w of the non-conductive zone in the dielectric filter 1B prepared for the testing. It will be appreciated that the waveform in vicinity of the center frequency is flattened and thus the frequency bandwidth is broadened as the width w of the non-conductive zone is reduced. The frequency bandwidth is gradually decreased as the width w of the non-conductive zone is increased over 0.20 mm. When the width w of the non-conductive zone is about 0.60 mm the frequency bandwidth becomes smaller than that in case no non-conductive zone is provided (w=0.00 mm) and thus a narrower frequency bandwidth is obtained. Therefore, by regulating the width w of the non-conductive zone based upon this phenomenon, it is possible to adjust the frequency bandwidth in the dielectric filter to a desired range. This means that the dielectric filter may be modified to have either a broader band or a narrower band.

Further, in FIGS. 7A–7D an attenuation pole is appeared on a high band zone of the frequency characteristic (a), while in FIGS. 10A–10D no attenuation pole is formed.

Therefore, the dielectric filters 1A and 1B prepared in accordance with the first and the second embodiments of the invention may have different filter characteristics, and thus may be intended to be used for different applications.

With the illustrated embodiments a two-stage dielectric filter has been described. Alternatively, the present invention may be applied to a multi-stage dielectric filter having three, or four or more resonators.

As described in detail, according to the present invention, there is provided a dielectric filter comprising a dielectric ceramic block, a plurality of juxtaposed resonators each resonator including a through hole provided within the block to be extended from a first end surface to a second end surface of the block and an inner conductor layer provided on an inner wall surface of the through hole, an outer conductor layer provided on outer surface portions of the block with exception of the first end surface, and input/output pads provided on the first lateral side surface of the block at respective positions close to the first end surface and opposite to the associated resonators, wherein a strip conductor member is provided transversely between the adjacent through holes on the first end surface of the block so that one end of the strip conductor member is connected to the outer conductor layer on one of a first and second lateral side surfaces of the block, and other end is separated from the other lateral side surface to form an open circuit end, whereby defining a non-conductive region between the open circuit end of the strip conductor member and the outer conductor layer on the other lateral side surface. With such an arrangement, a frequency bandwidth in the dielectric filter can be widened. Therefore it is possible to provide dielectric filter having a wider filter characteristic which is effectively required for various applications.

Also, by means of suitably setting of the width or space of the non-conductive region or insulation gap, the frequency bandwidth of the dielectric filter can be adjusted to a desired range. As a result it is possible to provide a dielectric filter having a wider or narrower frequency bandwidth dependent on the application purpose.

Furthermore, with the selective provision of the the non-conductive region or insulation gap on the open-circuit end surface of the block, the dielectric filter can be intended to conveniently define its filter characteristic.

What is claimed is:

1. A dielectric filter with adjustable frequency bandwidth, said filter comprising:

a dielectric ceramic block having first and second end surfaces, first and second lateral side surfaces opposite to each other, and third and fourth lateral side surfaces opposite to each other;

a plurality of juxtaposed resonators, each resonator including a through hole provided within the block and extending from the first end surface to the second end surface of the block and an inner conductor layer provided on an inner wall surface of the through hole;

an outer conductor layer disposed on outer surface portions of the block except for said first end surface;

input/output pads disposed on the first lateral side surface of the block at respective positions close to said first end surface, each pad being capacitively coupled with an associated resonator and being disposed opposite to the associated resonator;

a strip conductor member extending transversely between adjacent through holes on said first end surface of the block, the strip conductor member having one end connected to the outer conductor layer on the first lateral side surface of the block where the input/output pads are disposed, and an opposite end separated from the outer conductor layer on the second lateral side surface of the block so as to form an open circuit end; and a non-conductive region defined between the open circuit end of the strip conductor member and the outer conductor layer on the second lateral side surface.

2. A dielectric filter as claimed in claim 1, wherein said non-conductive region has a width selected for providing a relatively wide frequency bandwidth.

3. A dielectric filter as claimed in claim 1, wherein said non-conductive region has a width of about 0.20 mm to 0.40 mm.

4. A dielectric filter as claimed in claim 1, wherein said non-conductive region has a width selected for providing a relatively narrow frequency bandwidth.

5. A dielectric filter as claimed in claim 4, wherein the width of said non-conductive region is at least about 0.60 mm.

6. A dielectric filter with adjustable frequency bandwidth, said filter comprising:

a dielectric ceramic block having first and second end surfaces, first and second lateral side surfaces opposite to each other, and third and fourth lateral side surfaces opposite to each other;

a plurality of juxtaposed resonators, each resonator including a through hole provided within the block and extending from the first end surface to the second end surface of the block and an inner conductor layer provided on an inner wall surface of the through hole;

an outer conductor layer disposed on outer surface portions of the block except for said first end surface;

input/output pads disposed on the first lateral side surface of the block at respective positions close to said first end surface, each pad being capacitively coupled with an associated resonator and being disposed opposite to the associated resonator;

a strip conductor member extending transversely between adjacent through holes on said first end surface of the block, the strip conductor member having one end connected to the outer conductor layer on the second lateral side surface of the block, and an opposite end separated from the outer conductor layer on the other of the first lateral side surface where input/output pads are disposed so as to form an open circuit end; and a non-conductive region defined between the open circuit end of the strip conductor member and the outer conductor layer on the first lateral side surface of the block.

7. A dielectric filter as claimed in claim 6, wherein said non-conductive region has a width selected for providing a relatively wide frequency bandwidth.

8. A dielectric filter as claimed in claim 6, wherein said non-conductive region has a width of about 0.20 mm to 0.40 mm.

9. A dielectric filter as claimed in claim 6, wherein said non-conductive region has a width selected for providing a relatively narrow frequency bandwidth.

10. A dielectric filter as claimed in claim 9, wherein the width of said non-conductive region is at least about 0.60 mm.

11. A method of adjusting the frequency bandwidth of a dielectric filter comprising a dielectric ceramic block having first and second end surfaces and first and second lateral side surfaces opposite to each other, a plurality of juxtaposed resonators, each resonator including a through hole provided within the block and extending from the first end surface to the second end surface of the block and an inner conductor layer provided on an inner wall surface of the through hole, an outer conductor layer disposed on outer surface portions of the block except for said first end surface, and input/output pads disposed on the first lateral side surface of the block at respective positions close to said first end surface, each pad being capacitively coupled with an associated resonator and being disposed opposite to the associated resonator, the method comprising the steps of:

forming a strip conductor member extending transversely between adjacent through holes on said first end surface of the block so that one end of the strip conductor member is connected to the outer conductor layer on the first lateral side surface of the block, and an opposite end of the strip conductor is separated from the outer conductor layer on the second lateral side surface so as to form an open circuit end, and so as to define a non-conductive region between the open circuit end of the strip conductor member and the outer conductor layer on the second lateral side surface; and setting a width of the non-conductive region so as to adjust the frequency bandwidth of the filter.

12. A method as claimed in claim 11, wherein the width of said non-conductive region is set to provide a relatively wide frequency bandwidth.

13. A method as claimed in claim 11, wherein the width of said non-conductive region is set to provide a relatively narrow frequency bandwidth.

14. A method of adjusting a frequency bandwidth of a dielectric filter comprising a dielectric ceramic block having first and second end surfaces and first and second lateral side surfaces opposite to each other, a plurality of juxtaposed resonators, each resonator including a through hole provided within the block and extending from the first end surface to the second end surface of the block and an inner conductor layer provided on an inner wall surface of the through hole, an outer conductor layer provided on outer surface portions of the block except for said first end surface, and input/output pads disposed on the first lateral side surface of the block at respective positions close to said first end surface, each pad being capacitively coupled with an associated resonator and being disposed opposite to the associated resonator, the method comprising the steps of:

forming a strip conductor member extending transversely between adjacent through holes on said first end surface of the bock so that one end of the strip conductor member is connected to the outer conductor layer on the second lateral side surface of the block, and an opposite end of the strip conductor is separated from the outer conductor layer on the first lateral side surface so as to form an open circuit end, and so as to define a non-conductive region between the open circuit end of the strip conductor member and the outer conductor layer on the first lateral side surface of the block; and setting a width for the non-conductive region so as to adjust the frequency bandwidth of the filter.

15. A method as claimed in claim 14, wherein the width of said non-conductive region is set to provide a relatively wide frequency bandwidth.

16. A method as claimed in claim 14, wherein the width of said non-conductive region is set to provide a relatively narrow frequency bandwidth.

* * * * *